US010266371B2

(12) United States Patent
Hirabayashi

(10) Patent No.: US 10,266,371 B2
(45) Date of Patent: Apr. 23, 2019

(54) ELEVATOR CONTROL APPARATUS

(71) Applicant: Mitsubishi Electric Corporation, Chiyoda-ku (JP)

(72) Inventor: Kazufumi Hirabayashi, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 131 days.

(21) Appl. No.: 15/514,540

(22) PCT Filed: Oct. 22, 2014

(86) PCT No.: PCT/JP2014/078089
§ 371 (c)(1),
(2) Date: Mar. 27, 2017

(87) PCT Pub. No.: WO2016/063379
PCT Pub. Date: Apr. 28, 2016

(65) Prior Publication Data

US 2017/0225922 A1 Aug. 10, 2017

(51) Int. Cl.
*B66B 5/00* (2006.01)
*B66B 1/28* (2006.01)
*B66B 1/34* (2006.01)

(52) U.S. Cl.
CPC ..... *B66B 5/0018* (2013.01); *B66B 1/28* (2013.01); *B66B 1/3492* (2013.01)

(58) Field of Classification Search
CPC ..... B66B 5/0018; B66B 1/28; B66B 1/3492
USPC ..... 187/394
See application file for complete search history.

(56) References Cited

U.S. PATENT DOCUMENTS 4,864,208 A 9/1989 Schroder
9,809,419 B2 * 11/2017 Otsuka ..... B66B 1/36
(Continued)

FOREIGN PATENT DOCUMENTS

JP 57-41872 3/1982
JP 64-22783 A 1/1989
(Continued)

OTHER PUBLICATIONS

International Search Report dated Jan. 20, 2015 in PCT/JP2014/078089 filed Oct. 22, 2014.
(Continued)

*Primary Examiner* — David S Warren
(74) *Attorney, Agent, or Firm* — Oblon, McClelland, Maier & Neustadt, L.L.P.

(57) ABSTRACT

An elevator control apparatus that can estimate an error of a governor encoder caused by expansion and contraction of a governor rope without need to add new governor speed detectors. The elevator control apparatus includes: a governor rope expansion/contraction amount estimating device that estimates an error of a governor encoder caused by expansion and contraction of a governor rope on the basis of a governor encoder counter signal according to a rotation of a governor around which the governor rope connected to a car of an elevator provided in a building is wound, when a landing plate detector of the car is switched from a state in which a landing plate provided at a position corresponding to a floor of the building is detected to a state in which the landing plate is not detected.

5 Claims, 5 Drawing Sheets

(56) References Cited

U.S. PATENT DOCUMENTS

| | | | | |
|---|---|---|---|---|
| 2012/0143555 | A1* | 6/2012 | Nunley | B66B 5/04 702/113 |
| 2015/0336768 | A1* | 11/2015 | Otsuka | B66B 1/3492 187/394 |
| 2017/0008732 | A1* | 1/2017 | Shiraishi | B66B 5/12 |
| 2017/0225922 | A1* | 8/2017 | Hirabayashi | B66B 5/0018 |
| 2017/0327342 | A1* | 11/2017 | Hida | B66B 5/02 |
| 2018/0170710 | A1* | 6/2018 | Martin | B66B 1/44 |

FOREIGN PATENT DOCUMENTS

| | | | | |
|---|---|---|---|---|
| JP | 5-246636 | A | 9/1993 | |
| JP | 9-52669 | A | 2/1997 | |
| JP | 2004-51311 | A | 2/2004 | |
| JP | 2006-176215 | A | 7/2006 | |
| JP | WO 2016203650 | A1 * | 12/2016 | B66B 3/02 |

OTHER PUBLICATIONS

International Preliminary Report on Patentability and Written Opinion dated May 4, 2017 in PCT/JP2014/078089 (submitting English translation only).

Japanese Office Action dated Oct. 17, 2017 in Japanese Patent Application No. 2016-555005 (with English translation).

Office Action dated Aug. 23, 2018 in Korean Patent Application No. 10-2017-7012923 (with unedited computer generated English translation), 7 pages.

* cited by examiner

ELEVATOR CONTROL APPARATUS

FIELD

The present invention relates to an elevator control apparatus.

BACKGROUND

For example, PTL 1 discloses an elevator. The elevator includes two governor speed detectors. The elevator recognizes the position of a car on the basis of detected values of the two governor speed detectors. With this structure, it is possible to accurately recognize the position of a car of an elevator with a long travel, even when a governor rope of the elevator is expanded or contracted.

CITATION LIST

Patent Literature

[PTL 1] JP 2006-176215 A

SUMMARY

Technical Problem

However, the elevator disclosed in PTL 1 requires to be provided with two governor speed detectors. Thus, a normal elevator requires to be provided with add new governor speed detectors so as to take into consideration the expansion and contraction of the governor rope.

The present invention has been made to solve the above-mentioned problem. An object of the present invention is to provide an elevator control apparatus capable of estimating an error of a governor encoder caused by the expansion and contraction of a governor rope without the need to add new governor speed detectors.

Solution to Problem

An elevator control apparatus according to the present invention includes: a governor rope expansion/contraction amount estimating device that estimates an error of a governor encoder caused by expansion and contraction of a governor rope on the basis of a governor encoder counter signal according to a rotation of a governor around which the governor rope connected to a car of an elevator provided in a building is wound, when a landing plate detector of the car is switched from a state in which a landing plate provided at a position corresponding to a floor of the building is detected to a state in which the landing plate is not detected.

Advantageous Effects of Invention

According to the present invention, an error of the governor encoder caused by the expansion and contraction of the governor rope is estimated in consideration of the detected state of the landing plate detector. Accordingly, it is possible to estimate an error of the governor encoder caused by the expansion and contraction of the governor rope, without the need to add new governor speed detectors.

DESCRIPTION OF EMBODIMENTS

Figure 1:
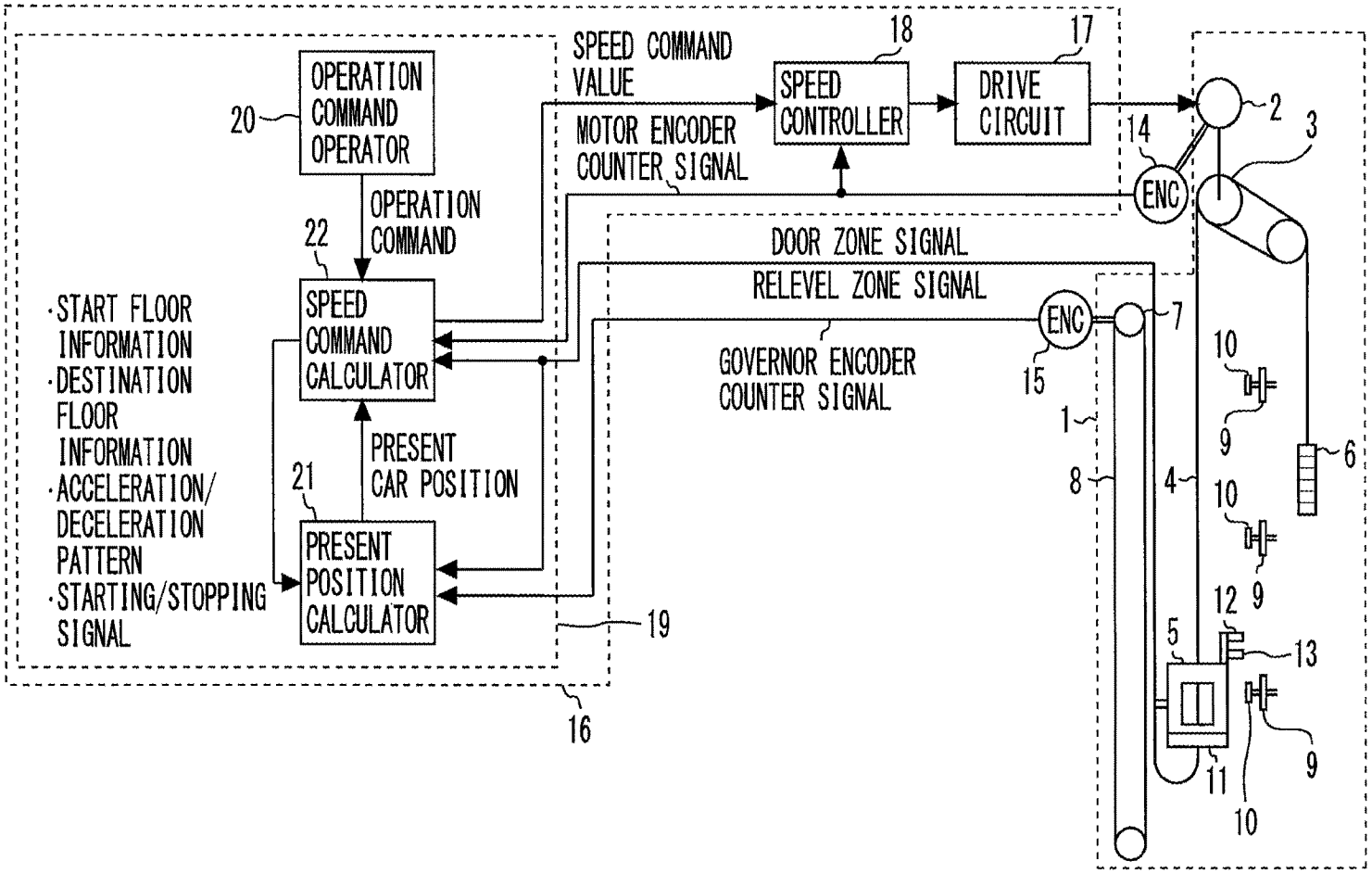
FIG. 1 is a block diagram of an elevator to which an elevator control apparatus according to a first embodiment of the present invention is applied.

Modes for carrying out the present invention will be described with reference to the accompanying drawings. Note that in the drawings, the same or corresponding parts are denoted by the same reference numerals. Repeated explanation of the parts is abbreviated or omitted as appropriate.

First Embodiment

FIG. 1 is a block diagram of an elevator to which an elevator control apparatus according to a first embodiment of the present invention is applied.

Referring to FIG. 1, a hoistway 1 penetrates floors of a building which is not shown. A motor 2 is provided above the hoistway 1. A sheave 3 is provided above the hoistway 1. The sheave 3 is attached to a rotation shaft of the motor 2. A main rope 4 is wound around the sheave 3.

A car 5 is provided in the hoistway 1. The car 5 is suspended at one end of the main rope 4. A counter weight 6 is provided in the hoistway 1. The counter weight 6 is suspended at the other end of the main rope 4.

A governor 7 is provided at an upper portion of hoistway 1. A governor rope 8 is wound around the governor 7. The governor rope 8 is connected to the car 5.

A plurality of door zone plates 9 are provided at positions respectively corresponding to door zones on the floors in the hoistway 1. Each of the plurality of door zone plates 9 is provided as a first landing plate. A plurality of relevel zone plates 10 are provided at positions respectively corresponding to relevel zones on the floors in the hoistway 1. Each of the plurality of relevel zone plates 10 is provided as a second landing plate. The length of each relevel zone plate 10 in the vertical direction is shorter than the length of each door zone plate 9 in the vertical direction.

The car 5 is provided with a weight detecting device 11. The weight detecting device 11 is provided so as to detect a weight value of a load in the car 5. The car 5 is also provided with a door zone plate detector 12. The door zone plate detector 12 is provided as a first landing plate detector. The door zone plate detector 12 is provided so as to detect each door zone plate 9 when the door zone plate detector 12 is disposed at the same height as that of the door zone plate 9. The door zone plate detector 12 is provided so as to transmit a door zone signal when the door zone plate 9 is detected. The car 5 is also provided with a relevel zone plate detector 13. The relevel zone plate detector 13 is provided as a second landing plate detector. The relevel zone plate detector 13 is provided so as to detect each relevel zone plate 10 when the relevel zone plate detector is disposed at the same height of the relevel zone plate 10. The relevel zone plate detector 13 is provided so as to transmit a relevel zone signal when each relevel zone plate 10 is detected.

A motor speed detector 14 is connected to the motor 2. The motor speed detector 14 is provided so as to transmit a motor encoder counter signal according to the speed of rotation of the motor 2. A governor speed detector 15 is connected to the governor 7. The governor speed detector 15 is provided so as to transmit a governor encoder counter signal according to the speed of rotation of the governor 7.

The control apparatus 16 includes a drive circuit 17, a speed controller 18, and a main control unit 19. The main control unit 19 includes an operation command operator 20, a present position calculator 21, and a speed command calculator 22.

The operation command operator 20 calculates an operation command for the elevator. The operation command operator 20 transmits the operation command.

The present position calculator 21 receives the governor encoder counter signal from the governor speed detector 15. The present position calculator 21 receives the door zone signal from the door zone plate detector 12. The present position calculator 21 receives the relevel zone signal from the relevel zone plate detector 13. The present position calculator 21 calculates the present position of the car 5 on the basis of the governor encoder counter signal, the door zone signal, the relevel zone signal, start floor information, destination floor information, an acceleration/deceleration pattern, and a starting/stopping signal.

The speed command calculator 22 receives a motor encoder counter signal from the motor speed detector 14. The speed command calculator 22 receives a door zone signal from the door zone plate detector 12. The speed command calculator 22 receives a relevel zone signal from the relevel zone plate detector 13. The speed command calculator 22 receives the operation command from the operation command operator 20. The speed command calculator 22 receives a signal indicating the present position of the car 5 from the present position calculator 21. The speed command calculator 22 calculates a speed command value on the basis of the governor encoder counter signal, the door zone signal, the relevel zone signal, the operation command, and the signal indicating the present position of the car 5. The speed command calculator 22 transmits, to the present position calculator 21, the start floor information, the destination floor information, the acceleration/deceleration pattern, and the starting/stopping signal. The speed command calculator 22 transmits the speed command value to the speed controller 18.

The speed controller 18 drives the drive circuit 17 on the basis of the speed command value. The drive circuit 17 drives the motor 2 on the basis of the speed command value. The sheave 3 is rotated in accordance with the driving of the motor 2. The main rope 4 is moved in accordance with the rotation of the sheave 3. The car 5 and the counter weight 6 ascend and descend at a desired speed in accordance with the movement of the main rope 4 along a guide rail which is not shown.

Figure 2:
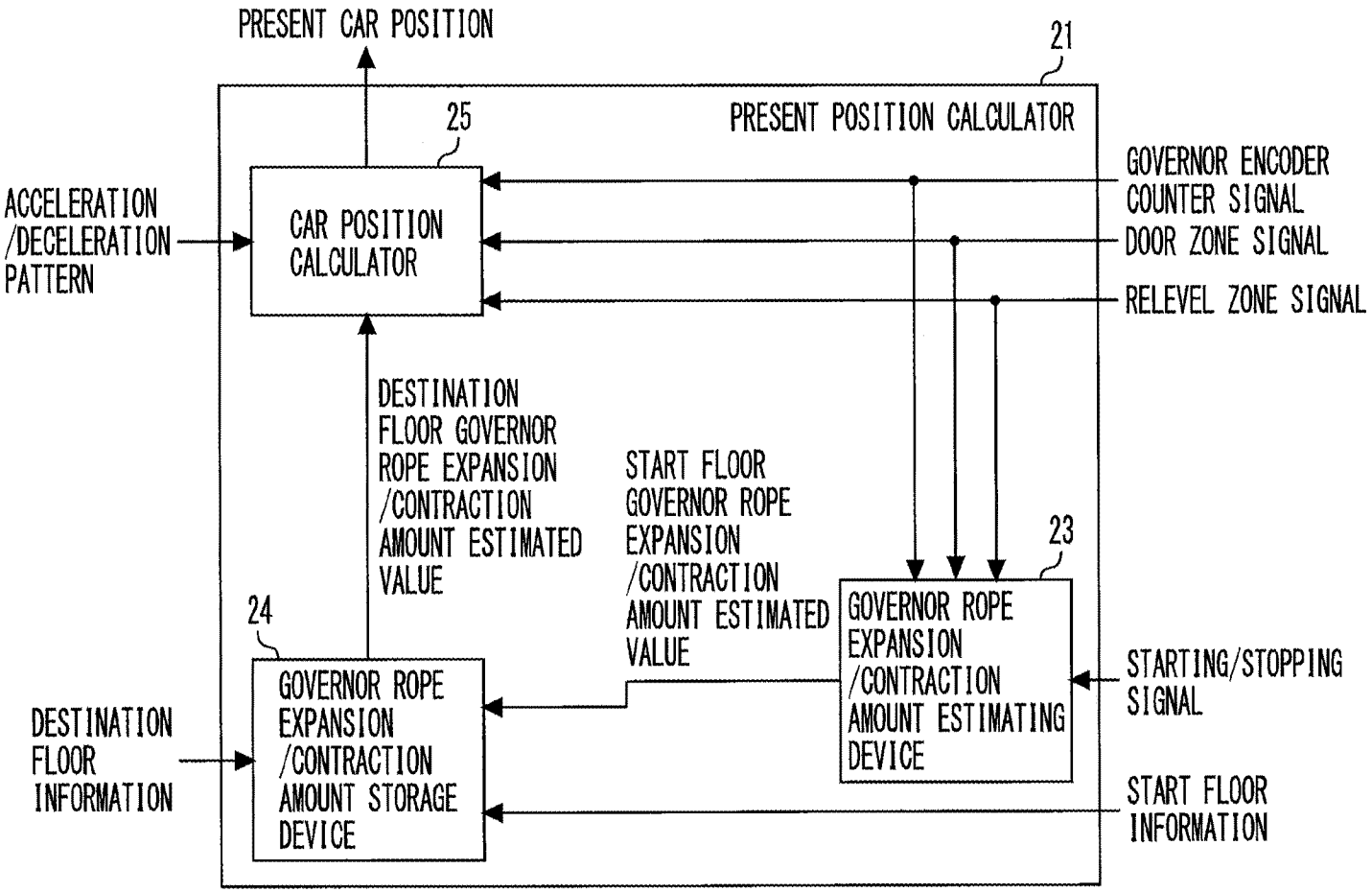
FIG. 2 is a block diagram of a present position calculator provided in the elevator control apparatus according to the first embodiment of the present invention.

Next, the present position calculator 21 will be described with reference to FIG. 2. FIG. 2 is a block diagram of the present position calculator provided in the elevator control apparatus according to the first embodiment of the present invention.

The present position calculator 21 includes a governor rope expansion/contraction amount estimating device 23, a governor rope expansion/contraction amount storage device 24, and a car position calculator 25.

The governor rope expansion/contraction amount estimating device 23 estimates the amount of expansion/contraction of the governor rope 8 corresponding to the floor from which the car 5 is started, on the basis of the governor encoder counter signal, the door zone signal, the relevel zone signal, and the starting/stopping signal. The amount of expansion/contraction of the governor rope 8 corresponds to an error of the governor encoder (an error in the position of the car 5) caused by the expansion/contraction of the governor rope 8.

The governor rope expansion/contraction amount storage device 24 stores, as the amount of expansion/contraction of the governor rope 8 on each floor, the estimated value of the amount of expansion/contraction of the governor rope 8 by the governor rope expansion/contraction amount estimating device 23 and start floor information in a manner linked to each other. Note that the governor rope expansion/contraction amount storage device 24 stores, in a manner linked to each other, information about the amount of expansion/contraction of the governor rope 8 estimated by complementation based on information about a plurality of floors on which the amount of expansion/contraction of the governor rope 8 is estimated, and information about the floors, for the floors on which the amount of the expansion and contraction of the governor rope is not estimated.

The governor rope expansion/contraction amount storage device 24 stores the information about the amount of expansion/contraction of the governor rope 8, which is linked to the floor, every time the amount of expansion/contraction of the governor rope 8 is estimated by the governor rope expansion/contraction amount estimating device 23. The governor rope expansion/contraction amount storage device 24 transmits the information about the amount of expansion/contraction of the governor rope 8 that is linked to the destination floor information of the car 5. According to an external command, the governor rope expansion/contraction amount storage device 24 transmits the estimated value of the amount of expansion/contraction of the governor rope 8 by the governor rope expansion/contraction amount estimating device 23 and the floor information in a manner linked to each other.

The car position calculator 25 calculates the present position of the car 5 on the basis of the governor encoder counter signal, the door zone signal, the relevel zone signal, the acceleration/deceleration pattern, and the estimated value of the amount of expansion/contraction of the governor rope 8 that is linked to the floor corresponding to the destination floor information of the car 5.

Next, the governor rope expansion/contraction amount estimating device 23 will be described with reference to FIG. 3.

Figure 3:
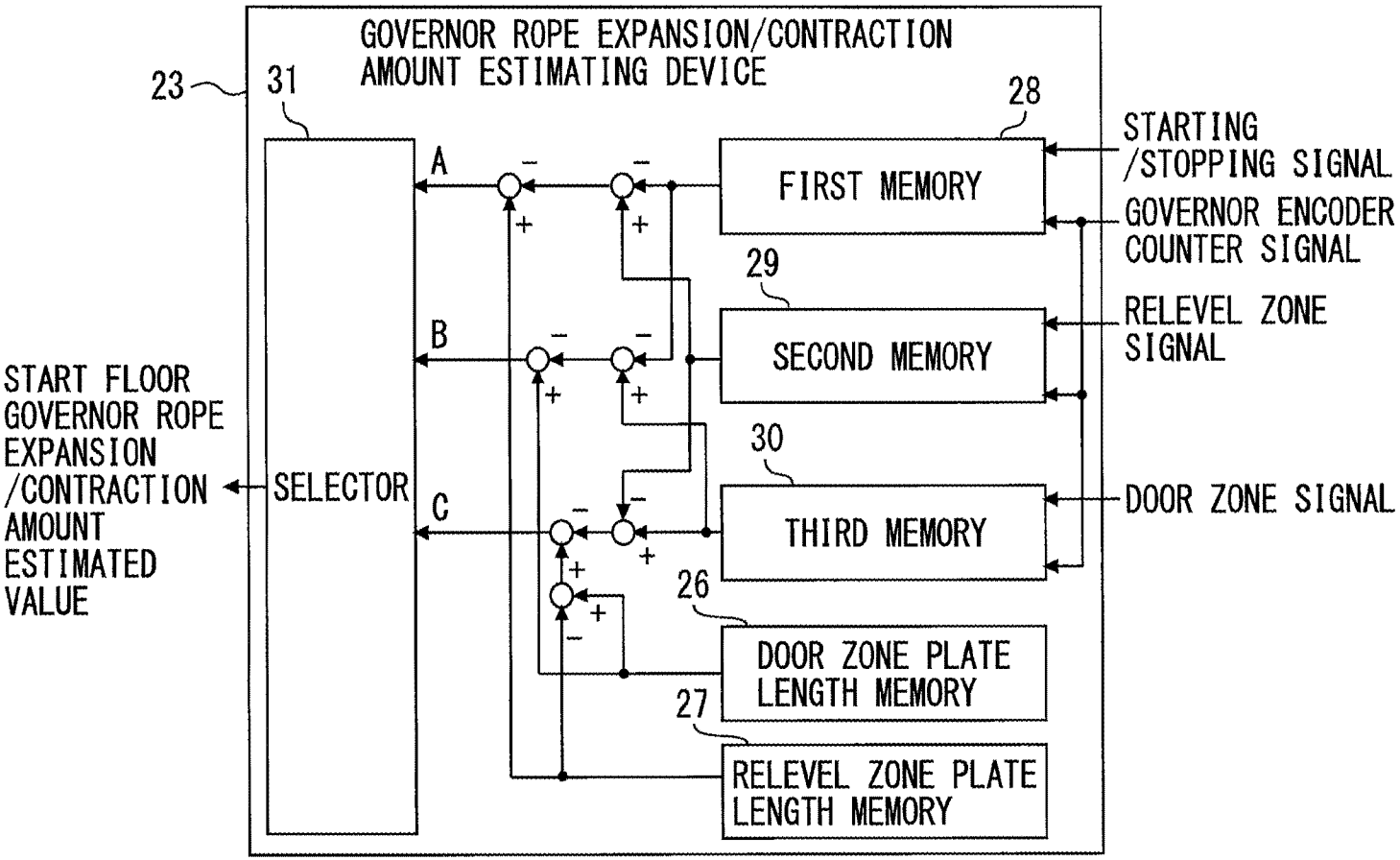
FIG. 3 is a block diagram of a governor rope expansion/contraction amount estimating device provided in the elevator control apparatus according to the first embodiment of the present invention.

FIG. 3 is a block diagram of the governor rope expansion/contraction amount estimating device provided in the elevator control apparatus according to the first embodiment of the present invention.

The governor rope expansion/contraction amount estimating device 23 includes a door zone plate length memory 26, a relevel zone plate length memory 27, a first memory 28, a second memory 29, a third memory 30, and a selector 31.

The door zone plate length memory 26 stores information about the length of the door zone plate 9 that is a design fixed value. The relevel zone plate length memory 27 stores information about the length of the relevel zone plate 10 that is a design fixed value.

The first memory 28 stores information about the value corresponding to the governor encoder counter signal when the car 5 is started from an N-th floor (N is an integer) on the basis of the starting/stopping signal. The second memory 29 stores information about the value corresponding to the governor encoder counter signal of the N-th floor when the car 5 escapes from the relevel zone on the N-th floor after departing from the N-th floor, on the basis of the relevel zone signal. The third memory 30 stores information about the value corresponding to the governor encoder counter signal of the N-th floor when the car 5 further travels and escapes from the door zone on the N-th floor, on the basis of the door zone signal.

The selector 31 selects the estimated value of the amount of expansion/contraction of the governor rope 8 from among a plurality of kinds of estimated values obtained from the information stored in each of the door zone plate length memory 26, the relevel zone plate length memory 27, the first memory 28, the second memory 29, and the third memory 30. The selector 31 transmits the selected estimated value as the estimated value of the amount of expansion/contraction of the governor rope 8 corresponding to the start floor.

For example, the selector 31 selects an estimated value A of the amount of expansion/contraction of the governor rope 8 as represented by the following formula (1).

Estimated value $A(N)$=(length of the relevel zone plate 10)−{(value corresponding to the governor encoder counter signal stored in the second memory 29)−(value corresponding to the governor encoder counter signal stored in the first memory 28)} (1)

For example, the selector selects an estimated value B of the amount of expansion/contraction of the governor rope 8 as represented by the following (2).

Estimated value $B(N)$=(length of the door zone plate 9)−{(value corresponding to the governor encoder counter signal stored in the third memory 30)−(value corresponding to the governor encoder counter signal stored in the first memory 28)} (2)

For example, the selector selects an estimated value C of the amount of expansion/contraction of the governor rope 8 as represented by the following formula (3).

Estimated value $C(N)$={(length of the door zone plate 9)−(length of the relevel zone plate 10)}−{(value corresponding to the governor encoder counter signal stored in the third memory 30)−(value corresponding to the governor encoder counter signal stored in the second memory 29)} (3)

Figure 4:
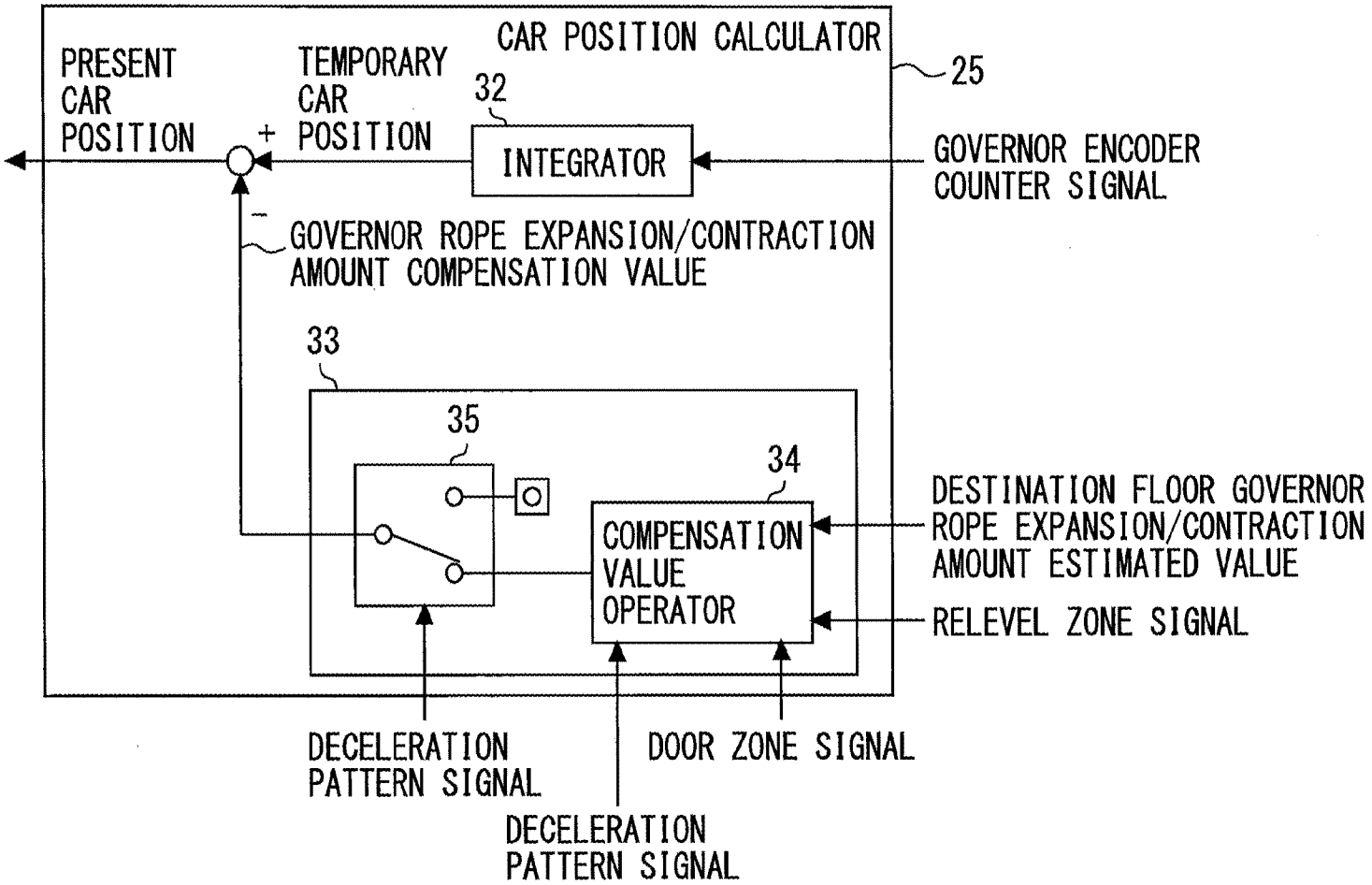
FIG. 4 is a block diagram of a car position calculator provided in the elevator control apparatus according to the first embodiment of the present invention.

Next, the car position calculator 25 will be described with reference to FIG. 4. FIG. 4 is a block diagram of the car position calculator provided in the elevator control apparatus according to the first embodiment of the present invention.

The car position calculator 25 includes an integrator 32 and a governor rope expansion/contraction amount compensator 33. The governor rope expansion/contraction amount compensator 33 includes a compensation value operator 34 and a switch 35.

The integrator 32 calculates a temporary position of the car 5 by integrating the value corresponding to the governor encoder counter signal.

The governor rope expansion/contraction amount compensator 33 performs compensation using the estimated value of the amount of expansion/contraction of the governor rope 8 corresponding to the destination floor from the governor rope expansion/contraction amount storage device 24, the door zone signal of the destination floor, the relevel zone signal of the destination floor, and the deceleration pattern signal.

Specifically, the compensation value operator 34 calculates a compensation value for the amount of expansion/contraction of the governor rope 8 by using the estimated value of the amount of expansion/contraction of the governor rope 8 corresponding to the destination floor, the deceleration timing by the deceleration pattern signal, the timing by the relevel zone signal of the destination floor, the timing by the door zone signal of the destination floor, and the like.

The switch 35 stops the transmission of the compensation value for the amount of expansion/contraction of the governor rope 8 from the compensation value operator 34 when the deceleration pattern signal is not received. The switch 35 transmits the compensation value for the amount of expansion/contraction of the governor rope 8 from the compensation value operator 34 when the deceleration pattern signal is received.

In this case, the present position of the car 5 is calculated by subtracting the compensation value for the amount of expansion/contraction of the governor rope 8 from the governor rope expansion/contraction amount compensator 33 from the value indicating the temporary position of the car 5 transmitted from the integrator 32.

Next, the estimated value of the amount of expansion/contraction of the governor rope 8 will be described with reference to FIG. 5.

Figure 5:
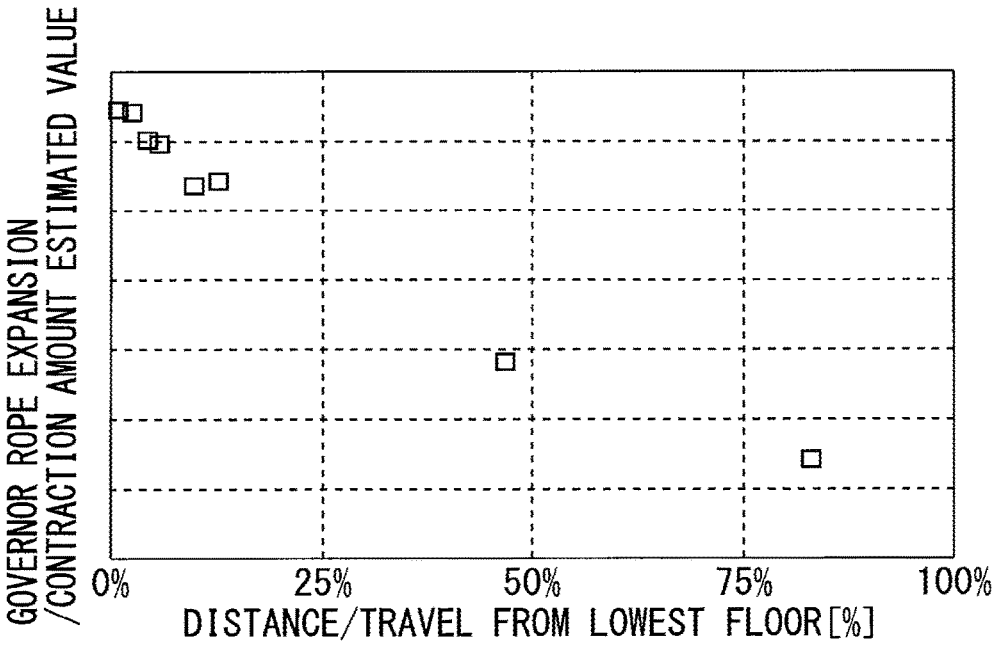
FIG. 5 is a graph showing the amount of expansion/contraction of a governor rope estimated by the elevator control apparatus according to the first embodiment of the present invention.

FIG. 5 is a graph showing the amount of expansion/contraction of the governor rope estimated by the elevator control apparatus according to the first embodiment of the present invention. The horizontal axis in FIG. 5 represents the ratio (%) of the distance from the lowest floor to the entire travel of the car 5. The vertical axis in FIG. 5 represents the estimated value of the amount of expansion/contraction of the governor rope 8 stored in the governor rope expansion/contraction amount storage device 24.

As shown in FIG. 5, as the ratio of the distance from the lowest floor to the entire travel of the car 5 decreases, the estimated value of the amount of expansion/contraction of the governor rope 8 stored in the governor rope expansion/contraction amount storage device 24 increases. In other words, the amount of expansion/contraction of the governor 8 is large in the vicinity of the lowest floor.

According to the first embodiment described above, an error of the governor encoder caused by the expansion and contraction of the governor rope 8 is estimated in consideration of the detected state of the relevel zone plate detector 13 or the door zone plate detector 12. Accordingly, an error of the governor encoder caused by the expansion and contraction of the governor rope 8 can be estimated without the need to add new governor speed detectors. As a result, the position of the car 5 can be accurately recognized even when the governor rope 8 is expanded or contracted due to spring characteristics during acceleration/deceleration of the car 5 of the elevator with a long travel in a high-rise building or the like.

Further, the car position calculator 25 corrects the position of the car 5 based on the error of the governor encoder caused by the expansion and contraction of the governor rope 8 when the door zone plate detector 12 is switched from a state in which the door zone plate 9 is not detected to a state in which the landing plate is detected, during deceleration of the car 5. Therefore, the position of the car 5 can be accurately recognized even when the car 5 has decelerated and landed. Consequently, a landing error of the car 5 and a variation during landing of the car 5 can be suppressed, which leads to an improvement in the ride quality of the car 5.

Further, the governor rope expansion/contraction amount storage device 24 stores, in a manner linked to each other, information about the error of the governor encoder caused by the expansion and contraction of the governor rope 8 and information about the floors. Accordingly, the position of the car 5 can be accurately recognized according to the position of each floor.

Further, the governor rope expansion/contraction amount storage device 24 stores, in a manner linked to each other, information about the error of the governor encoder caused by the expansion and contraction of the governor rope 8 that is estimated by complementation based on information about a plurality of floors on which the error of the governor encoder caused by the expansion and contraction of the governor rope 8 is estimated, and information about the floors, for the floors on which the error of the governor encoder caused by the expansion and contraction of the governor rope 8 is not estimated. Therefore, the position of the car 5 can be accurately recognized for the floor on which the car 5 lands first.

Further, the governor rope expansion/contraction amount storage device 24 re-stores information about the error of the governor encoder caused by the expansion and contraction of the governor rope 8 corresponding to the floor every time the governor rope expansion/contraction amount estimating device 23 estimates the error of the governor encoder caused by the expansion and contraction of the governor rope 8. Therefore, a secular change due to the expansion/contraction characteristics of the governor rope 8 can be dealt with.

Further, the governor rope expansion/contraction amount storage device 24 is provided so as to transmit, in a manner linked to each other, information about the error of the governor encoder caused by the expansion and contraction of the governor rope 8 estimated by the governor rope expansion/contraction amount estimating device 23 and information about the floors, to the outside. Therefore, the information about the error of the governor encoder caused by the expansion and contraction of the governor rope 8 can be effectively used during elevator maintenance work and the like.

INDUSTRIAL APPLICABILITY

As described above, an elevator control apparatus according to the present invention can be utilized for a system for estimating an error of the governor encoder caused by the expansion and contraction of the governor rope.

REFERENCE SIGNS LIST

1 Hoistway, 2 Motor, 3 Sheave, 4 Main rope, 5 Car, 6 Counter weight, 7 Governor, 8 Governor rope, 9 Door zone plate, 10 Relevel zone plate, 11 Weight detecting device, 12 Door zone plate detector, 13 Relevel zone plate detector, 14 Motor speed detector, 15 Governor speed detector, 16 Control apparatus, 17 Drive circuit, 18 Speed controller, 19 Main control unit, 20 Operation command operator, 21 Present position calculator, 22 Speed command calculator, 23 Governor rope expansion/contraction amount estimating device, 24 Governor rope expansion/contraction amount storage device, 25 Car position calculator, 26 Door zone plate length memory, 27 Relevel zone plate length memory, 28 First memory, 29 Second memory, 30 Third memory, 31 Selector, 32 Integrator, 33 Governor rope expansion/contraction amount compensator, 34 Compensation value operator, 35 Switch.

The invention claimed is:

1. An elevator control apparatus comprising:

a governor rope expansion/contraction amount estimating device that estimates an error of a governor encoder caused by expansion and contraction of a governor rope on the basis of a governor encoder counter signal according to a rotation of a governor around which the governor rope connected to a car of an elevator provided in a building is wound, when a landing plate detector of the car is switched from a state in which a landing plate provided at a position corresponding to a floor of the building is detected to a state in which the landing plate is not detected;

a governor rope expansion/contraction amount storage device that stores information about an error of the governor encoder that is linked to information about a floor on which the landing plate is provided, the error of the governor encoder being caused by the expansion and contraction of the governor rope estimated by the governor rope expansion/contraction amount estimating device; and a car position calculator that corrects a position of the car on the basis of the information about the error caused by the expansion and contraction of the governor rope, when the landing plate detector is switched from the state in which the landing plate is not detected to the state where the landing plate is detected during deceleration of the car, the information about the error being linked to the information about the floor on which the landing plate is provided.

2. The elevator control apparatus according to claim 1, wherein the governor rope expansion/contraction amount estimating device estimates, at each floor, an error of the governor encoder caused by the expansion and contraction of the governor rope, and the governor rope expansion/contraction amount storage device stores, linked to each other, information about an error of the governor encoder caused by the expansion and contraction of the governor rope estimated by the governor rope expansion/contraction amount estimating device at each floor and information about the floor.

3. The elevator control apparatus according to claim 1, wherein the governor rope expansion/contraction amount storage device stores, linked to each other, information about an error of the governor encoder caused by the expansion and contraction of the governor rope estimated by complementation based on information about a plurality of floors on which the error of the governor encoder caused by the expansion and contraction of the governor rope is estimated, and information about the floors, for the floors on which the error of the governor encoder caused by the expansion and contraction of the governor rope is not estimated.

4. The elevator control apparatus according to claim 1, wherein the governor rope expansion/contraction amount storage device re-stores information about an error of the governor encoder caused by the expansion and contraction of the governor rope, every time the governor rope expansion/contraction amount estimating device estimates the error of the governor encoder caused by the expansion and contraction of the governor rope, the information about the error being linked to the floor.

5. The elevator control apparatus according to claim 1, wherein the governor rope expansion/contraction amount storage device is configured to transmit information about an error of the governor encoder that is linked to information about the floor, the error being caused by the expansion and contraction of the governor rope estimated by the governor rope expansion/contraction amount estimating device.

* * * * *